US009192814B1

(12) United States Patent
Smart

(10) Patent No.: US 9,192,814 B1
(45) Date of Patent: Nov. 24, 2015

(54) TRANSFORMABLE PUSH-UP ASSEMBLY AND METHOD OF USE THEREOF

(71) Applicant: Joshua David Smart, Fort Lauderdale, FL (US)

(72) Inventor: Joshua David Smart, Fort Lauderdale, FL (US)

( * ) Notice: Subject to any disclaimer, the term of this patent is extended or adjusted under 35 U.S.C. 154(b) by 0 days.

(21) Appl. No.: 14/488,667

(22) Filed: Sep. 17, 2014

(51) Int. Cl.
*A63B 23/12* (2006.01)
*A63B 21/075* (2006.01)
*A63B 21/072* (2006.01)

(52) U.S. Cl.
CPC ..... *A63B 23/1236* (2013.01); *A63B 21/075* (2013.01); *A63B 21/0726* (2013.01); *A63B 2021/0722* (2013.01)

(58) Field of Classification Search
CPC ..... A63B 21/0724; A63B 21/0726; A63B 21/0728; A63B 23/1236; A63B 65/06; A63B 2021/072; A63B 2021/0722; A63B 21/00061; A63B 21/00065; A63B 21/0601; A63B 21/062; A63B 21/072–21/075; A63B 2021/0623; A63B 2225/09
USPC ..... 482/44–50, 92–93, 95–96, 106–108, 482/131, 133, 141
See application file for complete search history.

(56) References Cited

U.S. PATENT DOCUMENTS

| | | | | |
|---|---|---|---|---|
| 6,132,282 | A * | 10/2000 | Camp | 446/124 |
| 6,387,022 | B1 * | 5/2002 | Smith | 482/106 |
| 7,011,611 | B1 * | 3/2006 | Ripley | 482/107 |
| 7,585,262 | B1 * | 9/2009 | Vayntraub | 482/141 |
| 2012/0053024 | A1 * | 3/2012 | Mendoza | 482/106 |
| 2013/0137555 | A1 * | 5/2013 | Hodes et al. | 482/106 |
| 2015/0190672 | A1 * | 7/2015 | Rost | A63B 23/0355 482/93 |

* cited by examiner

*Primary Examiner* — Oren Ginsberg
*Assistant Examiner* — Jennifer M Deichl
(74) *Attorney, Agent, or Firm* — The Concept Law Group, P.A.; Scott D. Smiley; Mark C. Johnson

(57) ABSTRACT

A transformable push-up assembly and method of use thereof that includes first and second push-up bodies each having an upper end, a lower end, and an outer hemispherical surface spanning from the lower end of the push-up body toward the upper end of the push-up body, wherein each of the bodies have a handle coupled thereto. The assembly also includes a medicine-ball configuration with the first and second push-up bodies removably coupled together with at least one fastener and with the upper ends of the first and second push-up bodies in an overlapping adjacent relationship with each other and a push-up configuration with the first push-up body and the second push-up body uncoupled from, and independent of, one another and the handles of the first push-up body and the second push-up body disposed in a substantially upright orientation for gripping by the user.

20 Claims, 17 Drawing Sheets

100

100

100

600

700

700

1000

1000

TRANSFORMABLE PUSH-UP ASSEMBLY AND METHOD OF USE THEREOF

FIELD OF THE INVENTION

The present invention relates generally to work-out devices and, more particularly, relates to push-up devices.

BACKGROUND OF THE INVENTION

Strength training, which preserves and enhances lean muscle mass, is an important part of an overall fitness program or workout regimen. Of course, a strength-training program that targets the major muscle groups typically requires a gym' worth of equipment and a considerable amount of the user's time. Among the various strength-training exercises, the push-up is the quintessential upper-body exercise because it targets the large upper-body pectoral and triceps muscles. Done properly, the basic push-up also increases upper back strength and shoulder proprioception.

Devices that improve upon the basic pushup are well-known. For example, the most basic device allows the user to grasp a pair of handles positioned on the floor. The handles raise the position of the user's hands by several inches and thereby increase the range of motion as the user lowers his or her chest to the floor, past the position of the hands. This not only stretches the muscles but also requires additional exertion to raise the chest back to the starting position. Other push-up devices utilize rotating handles which arguably allow the user's arms to move more naturally and engage more muscles. Unfortunately, these devices only increase the range of motion of the hands, wrists, and forearms and otherwise do not develop muscle groups apart from those engaged with a traditional pushup. Further, both fixed-handle and rotating-handle push-up devices lack versatility because they are not adaptable for use with other strength-training exercises. They also require the user to store or travel with two separate bulky devices despite the devices being useful for only a single exercise. These push-up devices are also designed to provide the user with stable contact with the floor or ground, even though it may be desirable for a push-up device to be relatively unstable in order to develop muscles involved in balancing the body and enhancing motor skills and balancing coordination.

Other known push-up devices improve upon the aforementioned devices by providing an inflatable base. The inflatable base is intended to provide cushioning and also introduces an element of instability. These inflatable bases do not have an outer surface that is conducive for a large angular rotation with respect to the ground surface. Therefore, these devices provide an element of instability that is unforgiving of a user's orientating of the device beyond a certain degree of tilt, thereby providing an unsafe and dangerous device when the device is being used. Otherwise, the device suffers from the disadvantages of similar push-up devices having handles.

Most known push-up devices also fail to provide users the ability to transform into other workout devices that stimulate various other muscle groups. In this vein, those devices lack the ability for the user to effectively and efficiently add weight so they can be used in a progressive workout regime that may include weight training exercises such as bicep curls, chest presses, squats, etc.

Therefore, a need exists to overcome the problems with the prior art as discussed above.

SUMMARY OF THE INVENTION

The invention provides a transformable push-up assembly that overcomes the hereinafore-mentioned disadvantages of the heretofore-known devices and methods of this general type and that provides an assembly that can transform from a push-up device to a medicine ball and/or chest press device and/or curling device in order to effectively and efficiently provide an ergonomic assembly that stimulates various muscle groups and can be used for a variety of different work out activities.

With the foregoing and other objects in view, there is provided, in accordance with the invention, a transformable push-up assembly that includes one or two push-up bodies that each have a hemispherical outer surface extending from a ground contact surface substantially to an upper terminal periphery edge of the first push-up body and a handle coupled thereto that is recessed therein and has a user-gripping portion surrounded by the upper terminal periphery edge of the push-up body.

In accordance with a further feature of the present invention, the handle is fully recessed within the first push-up body and the hemispherical outer surface is of an elastically deformable material.

In accordance with another feature, an embodiment of the present invention includes at least one of two or more weight-increasing members (i.e., weights) removably coupled to the first push-up body with a fastener, the at least one of the plurality of weight-increasing members of a predetermined mass substantially equal to a positive integer value.

In accordance with a further feature of the present invention, the at least one of the plurality of weight-increasing members is circular.

In accordance with yet another feature, an embodiment of the present invention includes a male engagement member adapted to removably and fixedly couple with a complementary female engagement portion disposed on a second push-up body. The male and female engagement member may also retain the first push-up body and the second push-up body together to form a medicine-ball configuration as described below.

In accordance with an additional feature, another embodiment of the present invention includes a plate removably coupled to the first (or second) push-up body. The plate includes the handle coupled thereto, is at least partially defining a first push-up internal cavity, and has a cantilever arm extending from a bottom surface of the plate into the first push-up internal cavity. In said embodiment, at least one of a plurality of weights are removably coupled to the cantilever arm with a fastener, with the at least one of the plurality of weights of a predetermined mass substantially equal to a positive integer value.

In accordance with yet another feature, an embodiment of the present invention includes a second push-up body having a hemispherical outer surface extending from a ground contact surface substantially to an upper terminal periphery edge of the second push-up body and a handle coupled to the second push-up body and having a user-gripping portion surrounded by the upper terminal periphery edge and recessed within the second push-up body. The upper surface of the second push-up body and an upper surface of the first push-up body are then operably configured to fixedly couple with each other to form a spherical complete outer surface that includes the hemispherical outer surfaces of the first and second push-up bodies.

In accordance with an additional feature, an embodiment of the present invention includes a rigid bar having a first end with a female engagement portion of a complementary size and shape to, and operable to fixedly couple with, the male engagement member coupled to the first push-up body. The bar also includes a second end, opposite the first end of the rigid bar, with a male engagement member operable to fixedly couple with the female engagement portion disposed on the second push-up body, the female engagement portion disposed on the second push-up body of a complementary size and shape to the male engagement member on the second end of the rigid bar.

In accordance with the present invention, another variation of transformable push-up assembly is disclosed that has a (1) first and second push-up body having an upper end, a lower end, and a curvilinear outer surface spanning from the lower end of the first push-up body toward the upper end of the first push-up body and (2) a second push-up body having an upper end, a lower end, and a curvilinear outer surface spanning from the lower end of the second push-up body toward the upper end of the second push-up body. The first and second push-up bodies also include a handle coupled to their respective upper end of the body and are at least partially recessed therein. The embodiment also includes a medicine-ball configuration with the first push-up body and the second push-up body removably coupled together with at least one fastener and with the upper end of the first push-up body and the upper end of the second push-up body in an overlapping adjacent relationship with each other. Additionally, the assembly may then be transformed into a push-up configuration with the first push-up body and the second push-up body uncoupled from, and independent of, one another and the handles of the first push-up body and the second push-up body disposed in a substantially upright orientation with respect to a plane defined by the upper end of the respective first and second push-up body to which the handle is coupled.

In accordance with a further feature of the present invention, the handle coupled to the first push-up body and the handle coupled to the second push-up body unexposed to a viewing public when in the medicine-ball configuration.

In accordance with yet another feature of the present invention, the plane defined by the upper end of the first push-up body and the plane of the upper end of the second push-up body are substantially coplanar when in the medicine-ball configuration. Moreover, the curvilinear outer surface of the first push-up body and the curvilinear outer surface of the second push-up body are of an elastically deformable material.

In accordance with the present invention, a method of transforming a push-up device into another workout device is also disclosed that includes providing a first push-up device and a second push-up device, independent of the first push-up device. The first and second push-up devices each having an upper end, a handle coupled to the upper end and disposed in a substantially upright orientation with respect to a plane defined by the upper end to which the handle is coupled, a lower end, and an outer hemispherical surface spanning from the lower end toward the upper end. The method also includes coupling the upper end of the first push-up device and the upper end of the second push-up device with at least one fastener to retain the first and second push-up devices together and generating a medicine-ball configuration forming a spherical shape.

In accordance with an additional feature, the method may also include adding at least one of a plurality of weights to either the first push-up device and second push-up device, with the at least one of the plurality of weights being of a predetermined mass substantially equal to a positive integer value.

Although the invention is illustrated and described herein as embodied in a transformable push-up assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the push-up assembly from an end that makes contact with a ground surface toward a handle gripping portion.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
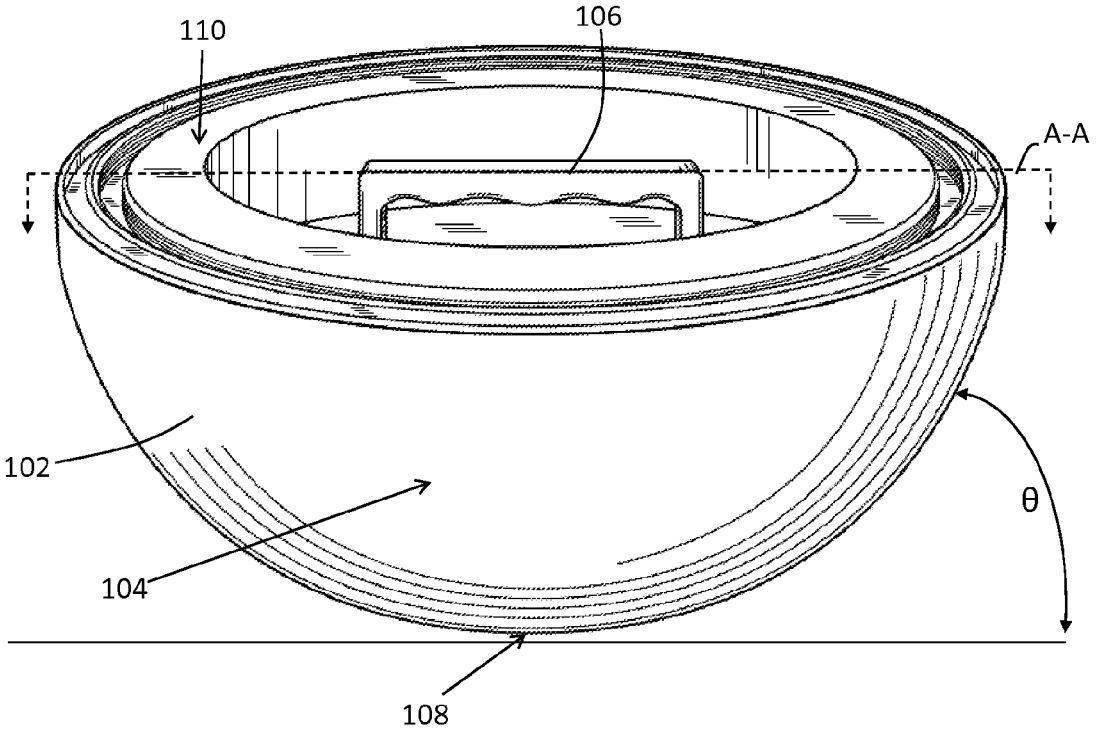
FIG. 1 is a downward-looking perspective view of a transformative push-up assembly in accordance with an embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient transformative push-up assembly that provides a user the ability to have extended ranges of motion in a push-up exercise that utilizes "controlled instability." Controlled instability is a concept whereby various muscle groups are used to stabilize the user or the workout device when the user is involved in a work out exercise with minimizing the risk of the user's limbs experiencing a quick, sharp, or sudden movement as a result of a lack of balance by the user. Embodiments of the invention also provide the ability for the push-up device to be transformed into various other workout devices or to be used effectively to emulate other workout exercises. For example, two push-up devices may be employed in one configuration to facilitate a user with a more effective push-up exercise. Those same push-up devices may then be employed in another configuration wherein weight can be added and they can be coupled together to form a medicine ball.

Referring now to FIG. 1, one embodiment of the present invention is shown in a downward-looking perspective view. FIG. 1 shows several advantageous features of the present invention, but, as will be described below, the invention can be provided in several shapes, sizes, combinations of features and components, and varying numbers and functions of the components. The first example of a transformative push-up assembly 100, as shown in FIG. 1, includes a push-up body 102 with a hemispherical outer surface 104 and a handle 106 coupled to the push-up body 102. Advantageously, the body 102 can be seen having a lower end 108 that includes a ground contact surface and an upper end 110, with the outer surface 104 spanning from the lower end 108 to the upper end to form a hemispherical shape. The hemispherical shape permits the user to engage in an instable push-up exercise, while simultaneously providing control to the user if the body 102 is oriented at extreme tilt angles (represented in FIG. 1 by angle θ).

"Hemispherical" is defined as having a shape approximating half of a sphere. In one embodiment, the outer surface 104 may include all points disposed on it equidistant to a fixed (and perhaps imaginary) point on the push-up body 102. In other embodiments, the outer surface 104 may include all points disposed on it within approximately +/−25% range deviation from one another to a fixed (and perhaps imaginary) point on the push-up body 102. In preferred embodiments, the deviation will be no more than +/−10%. As discussed in more detail below, when the outer surface 104 is beneficially composed of an elastically deformable material, the hemispherical shape is taken on said form when the body 102 is in a static, or non-use, state.

Figure 2:
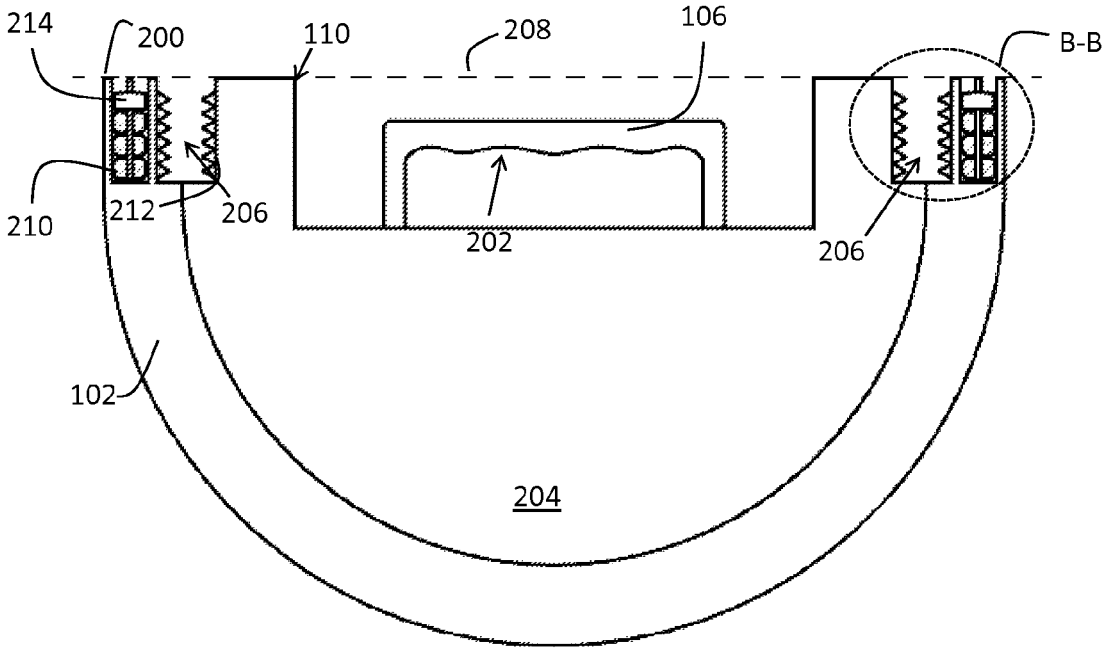
FIG. 2 is a cross-sectional view of the assembly of FIG. 1 along section A-A.
Figure 3A:
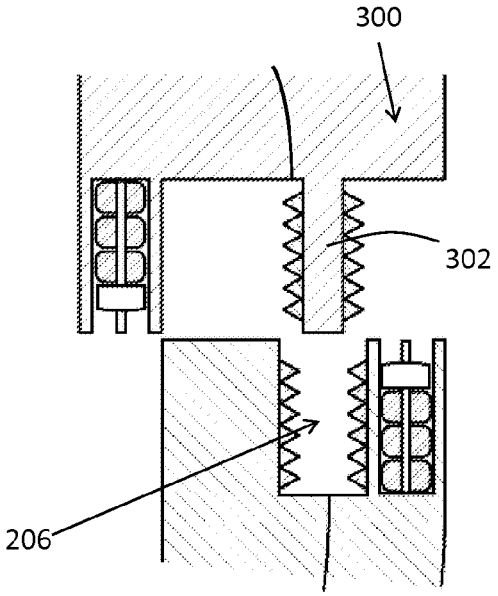
FIG. 3*a* is a close-up cross-sectional view of a female connection portion of the assembly in FIG. 2 at section B-B and a male portion of another push-up assembly in accordance with an embodiment of the present invention.

With reference now to FIG. 2, which depicts a cross sectional view of the first push-up body 102 in FIG. 1 along section A-A, the outer surface 104 can be seen extending from the ground contact surface 108 substantially to (e.g., within approximately 0-5 inches) an upper terminal periphery edge 200 of the push-up body 102. The upper terminal periphery edge 200 is the surrounding edge of the upper end 110 of the body 102. To minimize a high torque potential initiated by the user when gripping the handle 106 and operating the device 100, and to enable the first push-up body 102 to be combined with a second push-up body 400 (as depicted in FIG. 3*a*), the handle 106 is at least partially recessed within the body 102. Said another way, the handle 106 is at least partially recessed below the upper periphery edge 200 of the device. The recessed handle 106 also reduces the likelihood of wrist and hand injuries associated with known push-up devices utilizing a curvilinear outer surface.

Figure 4:
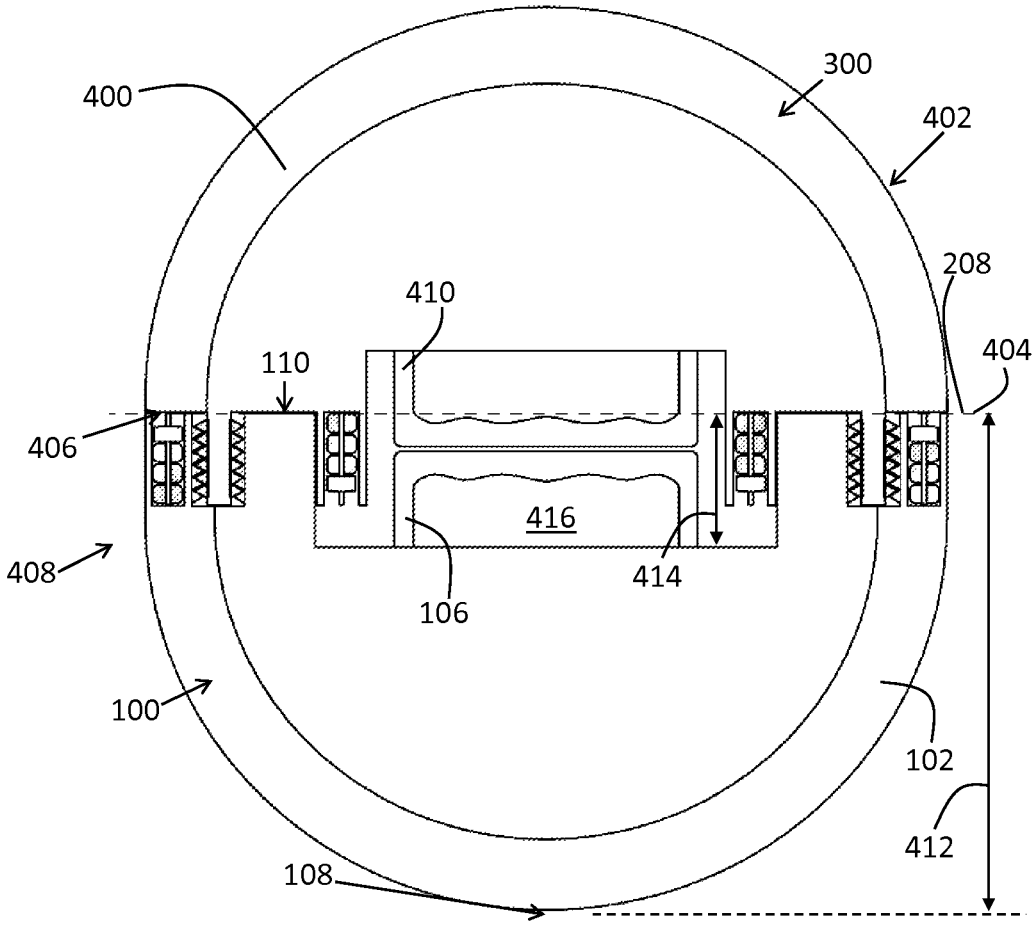
FIG. 4 is a cross-sectional view of the assembly of FIG. 2 coupled with another push-up assembly in accordance with an embodiment of the present invention.
Figure 17:
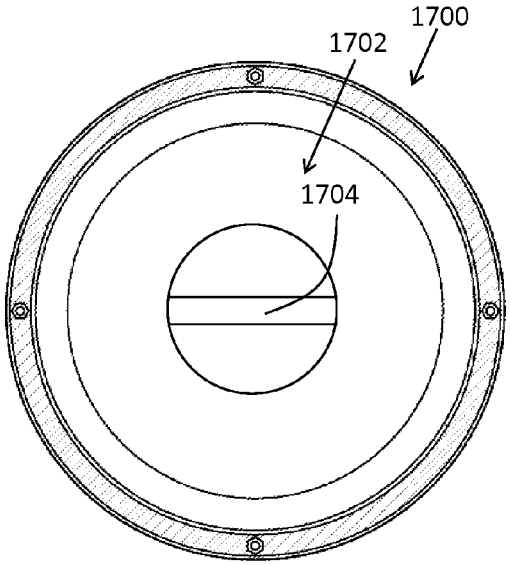
FIG. 17 is a top plan view of a push-up assembly in accordance with another embodiment of the present invention.
Figure 18:
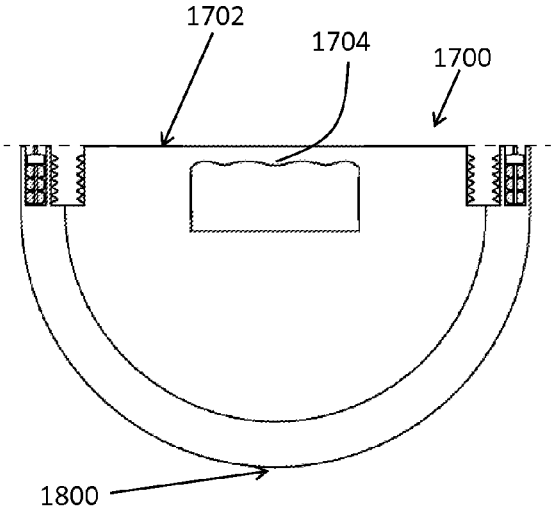
FIG. 18 is a cross-sectional view of the assembly of FIG. 17.

With reference briefly to FIGS. 17 and 18, in other embodiments the upper end 1702 of the assembly 1700 does not have the exposed area 416 as shown in FIG. 4. Rather, the upper end 1702 if formed of a substantially planar material and a handle 1704 is formed below said upper end 1702. Advantageously, this embodiment not only provides surface for the user to grip during a push-up configuration, but it also provides a surface for the user to safely stand on for improving balance when the assembly 1700 is used in a configuration where the lower end 1800 is adjacent a ground surface and the user stands on the upper end 1704 of one or more assemblies 1700.

Additionally, the handle 106 coupled to the push-up body 102 can also be seen disposed in a substantially upright orientation for gripping by the user. Said another way, the upper ends, e.g., 110 each define a plane (represented as plane 208 in FIG. 2) and the handle 106 is disposed at a 90 degree orientation (+/−15-20°) with respect to that plane 208. It preferable, however, to have the handle disposed at approximately 85-95° orientation with respect to said plane. The substantially upright orientation of the handle 106 enables the user to safely obtain more lateral movement to the curvilinear surface 104 of the body 102 when used in the push-up configuration as the user's wrist and hands are more balanced.

The handle 106 can also be seen having a user-gripping portion 202 that is surrounded by the upper terminal periphery edge 200 to facilitate in increasing the user's balance when using the device 100 in the push-up configuration. In preferred embodiments, the handle 106 is concentrically disposed at the upper end 110 of the push-up body 102. The user-gripping portion 202 may include notches/recesses sized to receive one or more portions of a user's fingers or other portion of the hand.

In one advantageous embodiment, the outer surface 104 of the push-up body 102 is of an elastically deformable material such as PVC plastic. In other embodiments, the outer surface 104 may be composed of neoprene, a composite material, a metallic material, a fabric material, or another material that may or may not have deformably elastic properties (e.g., to change its shape and and return back to its static-state shape after its change in shape). In one embodiment of the present invention, the device 100 includes a fluid cavity 204 that is enclosed and operable to exert a pressure against the outer surface 104 of the body 102 when filled with a fluid, e.g., air. As such, the outer surface 104 may define an aperture fluidly coupled to a valve that enables the user to fill the cavity 204 with a fluid and retain the same therein. The gauge pressure inside the cavity 204 may be operably modified by a user to adjust the degree of resistance the outer surface 104 has to external force(s)/pressure(s). In other embodiments, the cavity may be filled with another material such as sand or polymeric gel or the outer surface 104 may be defined by an outer layer of material that operate to provide the resistance to external force(s)/pressure(s).

Figure 3B:
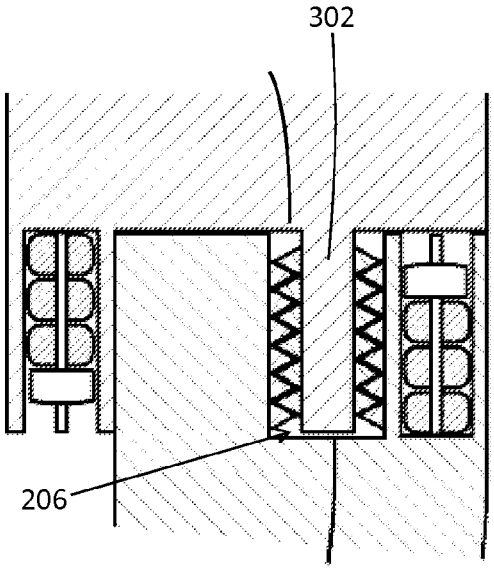
FIG. 3*b* is close-up cross-sectional view of the female and male connection of FIG. 3*a* coupled to one another.

With reference now to FIGS. 2 and 3*a-b*, to facilitate in the attachment of a first push-up device 100 to a second push-up device 300 (or to another work-out device), either the first or second push-up devices 100, 300 include a male engagement member 302 adapted to removably and fixedly couple with a complementary female engagement portion 206 disposed the another push-up device. As shown in FIGS. 2 and 3*a-b*, it is the first push-up assembly 100 that includes the complementary female portion 206 and the second push-up assembly 300 includes the male member 302. In other embodiments, only one of the push-up assemblies 100, 300 have a male member 302 or female portion 206. In other embodiments, both push-up assemblies 100, 300 have a male member 302 and a female portion 206. The female portion 206 is said to be complementary as it is sized and shaped to receive the male portion 302. In one embodiment, the male and female portions 302, 206 of the push-up assemblies 100, 300 may include a threading mechanism used to retain the assemblies 100, 300 together.

In other embodiments, the male and female portions 302, 206 of the push-up assemblies 100, 300 may include a tongue-and-grove configuration, a hook-and-loop configuration, or other fastening mechanisms. In further embodiments, the push-up assemblies 100, 300 may be coupled together using one or more magnets having a sufficient magnetic force to retain the weight of the respective device attached thereto. To facilitate in the release of the push-up assemblies 100, 300 when magnets are used, the assemblies 100, 300 may employ the use of an electromagnet and an electrical source, e.g., battery.

Therefore, using FIGS. 2-4 as an example, to couple and retain two push-up assemblies 100, 300 (or a push-up assembly with another workout device such as a curl bar) together the user rotates one or both of the first and second push-up assemblies 100, 300 so the male engagement member 302 screws into the complementary female portion 206. This configuration advantageously emulates a medicine ball (shown in FIG. 4) and provides a user the ability to use said assembly for various other workout exercises. To uncouple the push-up assemblies 100, 300 from one another, the user rotates one or both of the first and second push-up assemblies 100, 300 in the opposite direction used to retain the assemblies 100, 300 together.

To effectuate the medicine-ball configuration, the second push-up assembly 300 may also advantageously utilize a body 400 having hemispherical outer surface 402 or other curvilinear surface as similarly described above with regard to the first push-up assembly 100. In this vein, those descriptions of the features and characteristics herein with regard to the first push-up assembly 100 are equally applicable with respect to the second push-up assembly 300. As depicted in FIG. 4, when the two assemblies 100, 300 are coupled together at their respective ends 110, 406, the outer surfaces 104, 402 form a spherical complete outer surface 408. Said another way, the outer surfaces 104, 402 both form a spherical shape.

Referring specifically to FIG. 4, when the assemblies 100, 300 are in the medicine-ball configuration the handles 106, 410 coupled to the respective first and second push-up bodies 102, 400 are beneficially unexposed to the viewing public. Furthermore, the plane 208 defined by the upper end 110 of the first push-up body 102 and the plane 404 of the upper end 406 of the second push-up body 400 are substantially coplanar (having one or more points sharing the same plane or within 1 inch deviation from one another) when in the medicine-ball configuration. Not only do the unexposed handles and substantially coplanar planes 208, 404 effectuate a more ergonomic and maneuverable device with a geometry and shape that enables users to carry out those exercises associated with a medicine ball, but it also increases safety and is more aesthetically pleasing as the handles 106, 410 and various openings are not exposed to the user.

In other embodiments of the invention, the user may remove the assemblies 100, 300 in FIG. 4 and place their respective ends 110, 406 direction against a ground surface so the user may participate in floor balancing exercises. This advantageously provides the user the ability stimulate muscle fibers in his or her lower body by standing one or two of the assemblies 100, 300. In said embodiment, the respective ends 110, 406 will define a substantially planar surface such that the ends 110, 406 of the assemblies 100, 300 are flush with the floor surface, thereby minimizing the risk for injury to the user. The body 102 can also be seen having a height 412 separating the upper and lower ends 110, 108 of approximately 6-8 inches to provide a compact, yet effective, assembly for use in accordance with the present invention. The height 414 of the cavity 416 where the handle 106 is recessed may be approximately 3-5 inches to provide sufficient clearance of the user's hands when utilizing the assemblies 100, 300 in the push-up configuration. The heights 412, 414, however, may vary outside of these ranges depending on the design applications for the assemblies 100, 300.

Figure 5:
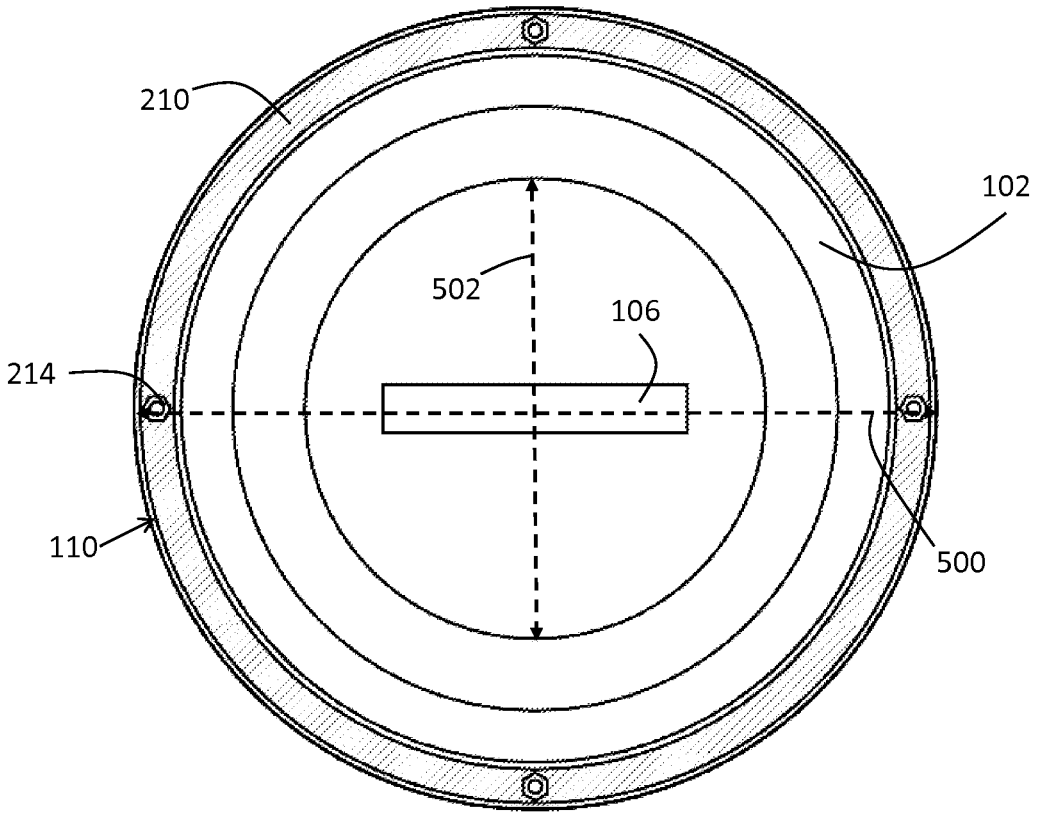
FIG. 5 is a top plan view of the assembly of FIG. 1.

With reference now to FIGS. 2 and 5, the first push-up assembly 100 can be seen with one or more weight-increasing members 210 removably coupled thereto. To advantageously increase the overall weight of the assembly 100, the body 102 is adapted to receive and retain one or more weight-increasing members 210 of a predetermined mass substantially equal (e.g., within 5-15% deviation) to a positive integer value. Said another way, the weight-increasing members 210 are of varying predetermined weights that are rounded to the nearest whole number, e.g., 11 lb, 2 lbs, 5 lbs, 10 lbs, 15 lb, etc. Unlike those known push-up assemblies that are one-dimensional, the transformative push-up assembly 100 enables the user to increase the weight associated with the assembly, which users find extremely beneficial when utilizing the assembly in the medicine-ball configuration, in bicep curls, in the connection with a bar, or another work-out or exercise device configuration.

In one embodiment, the weights 210 will take the form of annulus or ring-shaped object having an outer diameter of approximately 11 inches and an inner diameter of approximately 10 inches. This provides a width of approximately 1 inch, which is conducive for placement and storage in the body 102. The weight-increasing members 210 may be made with a material such as iron, having a density of approximately 0.284 lbs/in$^3$. In said embodiment, the thickness of the weight-increasing members 210 will then vary depending on the amount of weight desired to be produced. For example, to generate 5 lb, 10 lb, and 15 lb weight-increasing members 210, the corresponding thickness will be approximately 1.07 inches, 2.14 inches, and 3.2 inches, respectively. In other embodiments, the density of the material or the dimensions/geometry of the weight-increasing members 210 may be modified based on the design application(s).

In one embodiment of the present invention, the plurality of weight-increasing members 210 are circular to adapt to the circular nature of the body 102 and maximize spatial efficiency. In other embodiments, the plurality of weight-increasing members are rectangular, triangular, or another polygonal-shaped object. The weight members 210 are also preferably uniform in weight distribution and placement in relation to the body 102 to maintain a center of mass aligned with a portion of the handle 106. This beneficially maintains the balance of the assembly 100 when utilized for a curling exercise, when in the medicine-ball configuration, or when used in another workout exercise or emulating another work-out device.

Still referring to FIGS. 2 and 5, the one or more weights 210 may be retained to the body 102 by utilizing one or more threaded posts 212 that are inserted into one or more apertures defined by the weights 210 and then screwing a fastener 214, e.g., a nut, onto the end of the threaded post 212. In other embodiments, the assembly 100 may utilize a spring clip, a spring-loaded clamp, or other fastener that prevents the weights from becoming dislodged when the assembly 100 is in use.

With reference specifically to FIG. 5, in one embodiment the body 102 may have a diameter 500 (width) at the end 110 of approximately 12-13 inches and a diameter 502 of the inner area where the handle is attached and recessed of approximately 6-7 inches. The diameters 500, 502 and various other dimensions of the body 102 may vary outside of these ranges depending on the application and design requirements.

Figure 6:
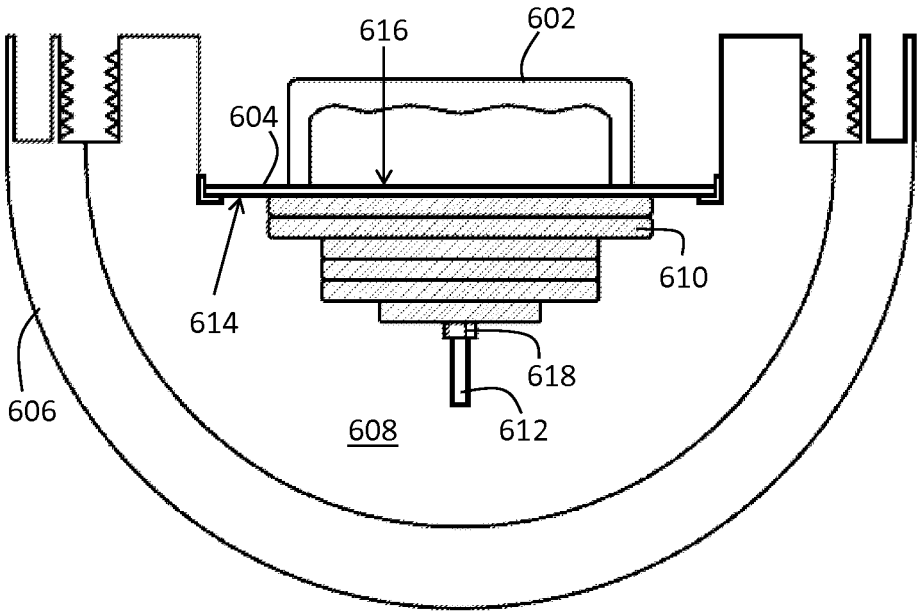
FIG. 6 is a cross-sectional view of a transformative push-up assembly in accordance with another embodiment of the present invention.

Referring now to FIG. 6, another embodiment of the transformative push-up assembly 600 is depicted in a cross-sectional view. FIG. 6 depicts the handle 602 coupled to an upper surface 616 of a plate 604 that is removably couplable to a push-up body 606. The plate 604 at least partially defines a push-up internal cavity 608 that may be advantageously used to retain additional or all weight-increasing members 610. The plate 604 may include a cantilever arm 612 extending from a bottom surface 614 of the plate 604 into the first push-up internal cavity 608. When additional weight is desired to be added to the assembly 600, the user may place one or more weights of varying or equivalent weight through the arm 612 and retains the weight with a fastener 618. The fastener 618 may be of the same or different from the fastener 214 described above. Moreover, the weights 610 are also preferably uniform in weight distribution and placement in relation to the body 102 to maintain a center of mass aligned with a portion of the handle 602. In one embodiment, the plate 604 may be removably couplable to the body 606 using screw threading. In other embodiments, the plate 604 may be removably couplable to the body 606 using one or more nuts/bolts, spring clips, screws, a tongue-and-grove configuration, or other fastening mechanisms known by those of skill in the art.

Figure 7:
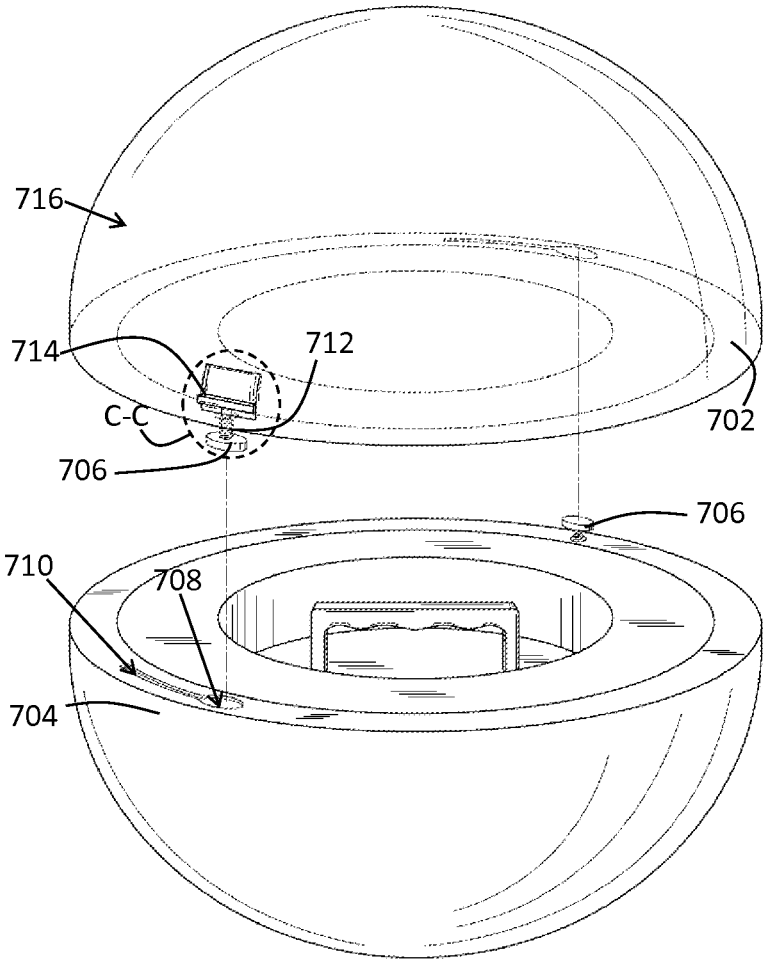
FIG. 7 is downward-looking perspective view of a first and second transformative push-up assembly in accordance with one embodiment of the present invention.
Figure 8:
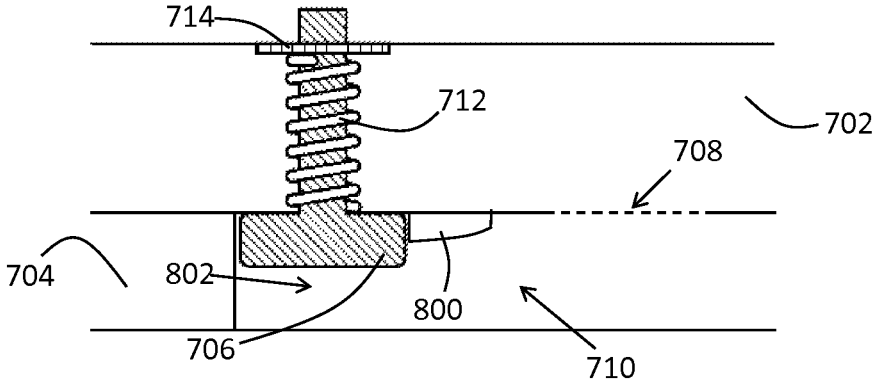
FIG. 8 is a close-up cross-sectional view of the male/female connection mechanism of FIG. 7 along section C-C.

With reference now to FIGS. 7 and 8, another embodiment of the assembly 700 is shown in a downward-looking perspective view and close-up cross-sectional view, respectively. Opposed to a screw thread configuration as depicting above for the assembly 100, first and second push-up bodies 702, 704 may be operably coupled together using a translatable latch member 706 (e.g., a male portion) coupled to one push-up body (e.g., body 702) that is inserted into an opening 708 (e.g., female recess) and channel 710 formed on another push-up body (e.g., body 704). The latch member 706 may be biased to position—preferably in a direction way from the opening 708—using a spring 712 and may be translated using a notch 714 accessible from the outer surface 716 of the body 702. To couple the body 702 to the body 704, as similarly described above, the latch member 706 has a portion that is extended outwardly using the notch 714 and then inserted into the opening 708 on the body 704 and then rotated across a ramp 800 and locked into place within a locking zone 802. The locking zone 802 is shaped and sized to prevent the portion of the latch member 706 from moving laterally, thereby, in connection with the spring 712, retaining the bodies 702, 704 together.

Figure 9:
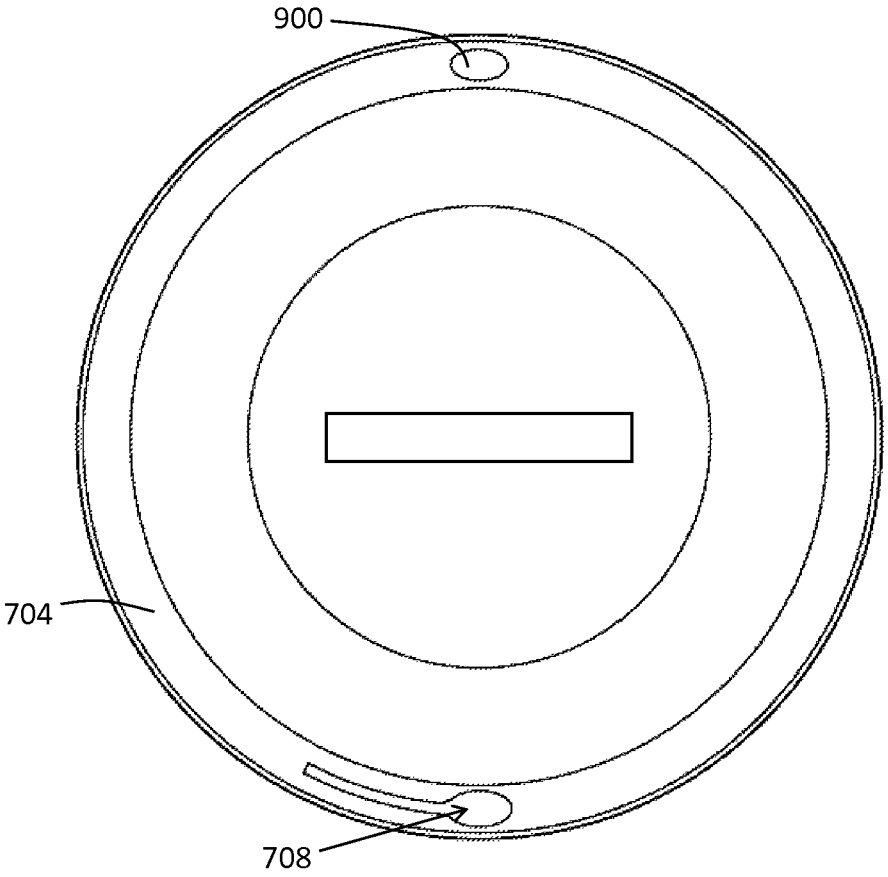
FIG. 9 is a top plan view of the first push-up assembly of FIG. 7.

When the bodies 702, 704 are desired to be uncoupled from one another, the user moves the notch 714 downwardly and rotates one or more of the bodies 702, 704 to move the portion of the latch member 706 through the channel 710 and out through the opening 708. In one embodiment, two latch members 706 along with two female portions are utilized, with one latch member 706 and one female portion used on each body 702, 704 as shown in FIG. 7. This beneficially reduces manufacturing costs as one mold may be used to create both halves of the assembly. In other embodiments, one push-up body may have two latch portions and another push-up body will have female portions corresponding to the latch portions. FIG. 9 depicts top plan view of the body 704 of the assembly 700 shown in FIG. 7. As shown in FIG. 9, the male portions 706, 900 in FIG. 7 fit within a corresponding opening 708 that is shaped and sized to not only receive the male portions 706, 900 to be inserted into, but also to be translated within the channel 710. It will be apparent to those of skill in the art that the male portion 706 is the portion which is inserted within the opening 708, and not the male portion 900.

Figure 10:
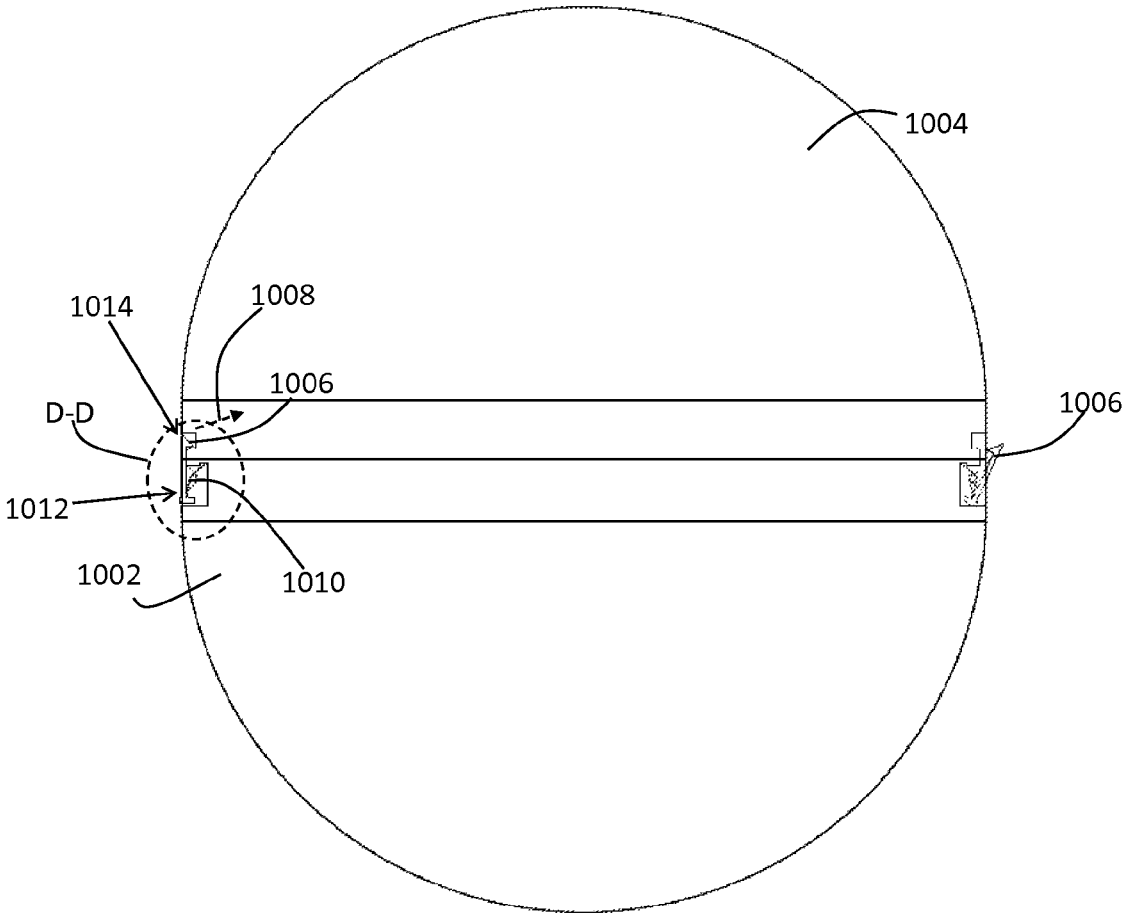
FIG. 10 is downward-looking perspective view of a first and second transformative push-up assembly coupled together to form a medicine ball configuration in accordance with one embodiment of the present invention.
Figure 11:
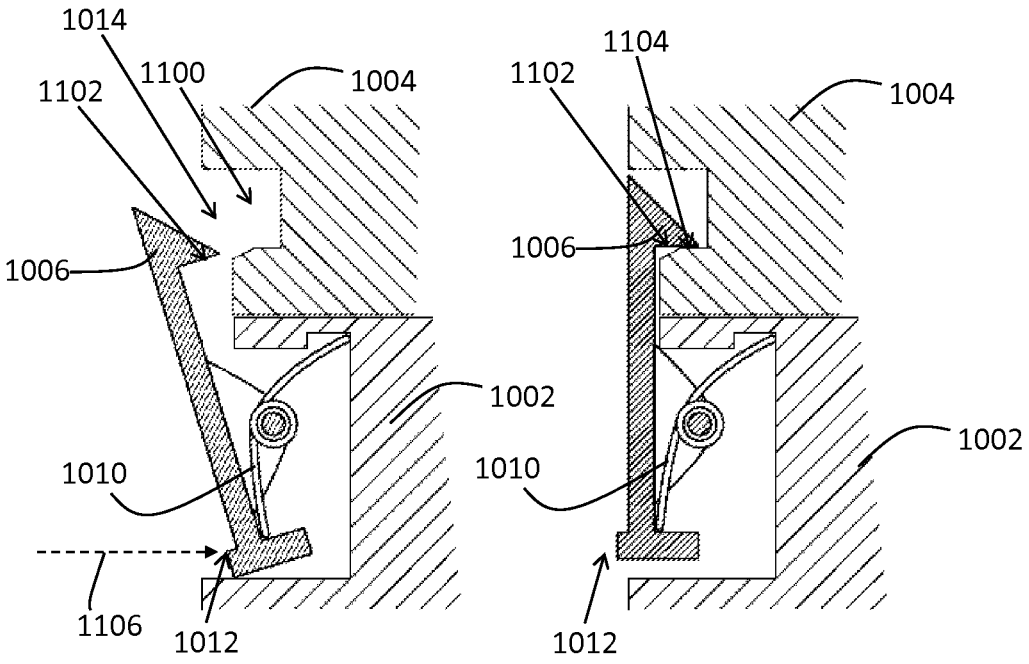
FIG. 11 is a close-up cross-sectional view of the male/female connection mechanism of FIG. 10 along section D-D.
Figure 12:
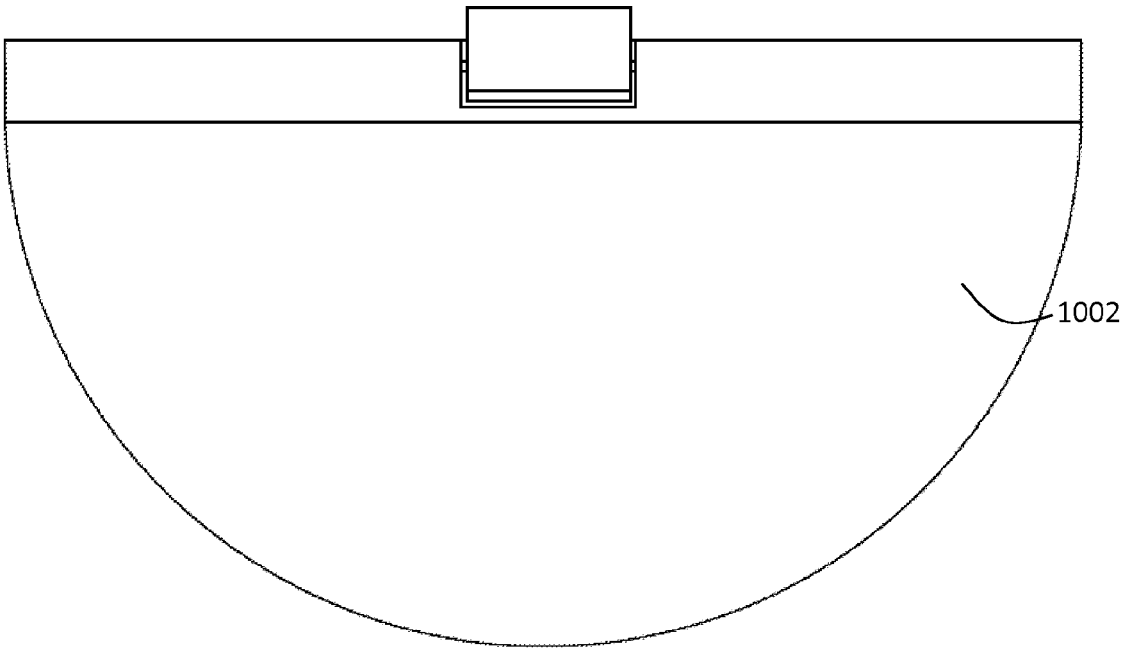
FIG. 12 is an elevational side view of the first transformative push-up assembly of FIG. 10.
Figure 13:
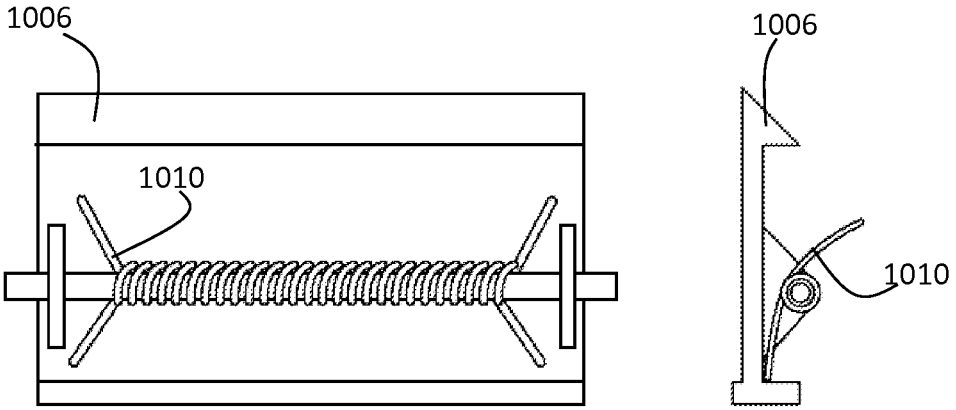
FIG. 13 is a close-up rear and side view of the male connection mechanism of FIG. 12.
Figure 14:
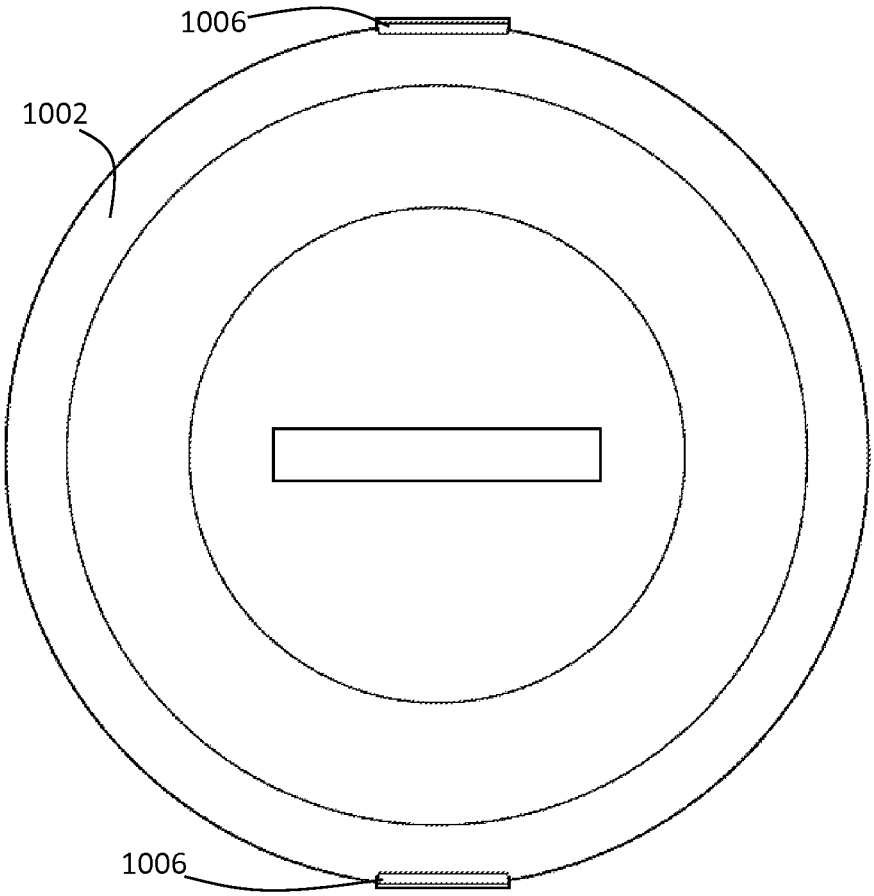
FIG. 14 is a top plan view of the first push-up assembly of FIG. 10.

With reference now to FIGS. 10-14, another embodiment of the assembly 1000 is shown. FIG. 10 depicts two push-up bodies 1002, 1004 coupled together in a medicine-ball configuration and FIG. 11 depicts a close-up cross-sectional view of section D-D in FIG. 10. FIGS. 12 and 14 depict an elevational side view and top plan view of the body 1002, respectively. FIG. 13 depicts a close-up back and side elevation view of the exemplary male-female connections used to couple and retain the bodies 1002, 1004 together. To couple the two bodies 1002, 1004 together, the user presses a lower exposed portion 1012 of a translatable latch 1006 that is biased in a direction toward the internal cavity of the body 1004 (indicated with arrow 1008) with a spring 1010.

The latch 1006 may be shaped and sized such that when it is inserted a particular distance into a complementary opening 1014 and channel 1100, a portion 1104 of the latch 1006 engages with a portion 1104 of the body 1004 to retain the bodies 1002, 1004 together in a flush and substantially coplanar relationship with one another, as similarly described above for other embodiments of the push-up bodies. FIG. 11 depicts the latch 1006 in a dynamic position (left) whereby the user depresses the portion 1012 with a force (indicated with arrow 1106) to move the end of the latch 1006 away from the body 1004 and a static position (right) whereby the portion 1102 of the latch 1006 is engaged with a portion 1104 of the body 1004. To remove the two bodies 1002, 1004, the user depresses lower exposed portion 1012 of a translatable latch 1006 and either lifts the body 1004 or uses gravity to let the body 1004 uncouple from the body 1002.

Figure 15:
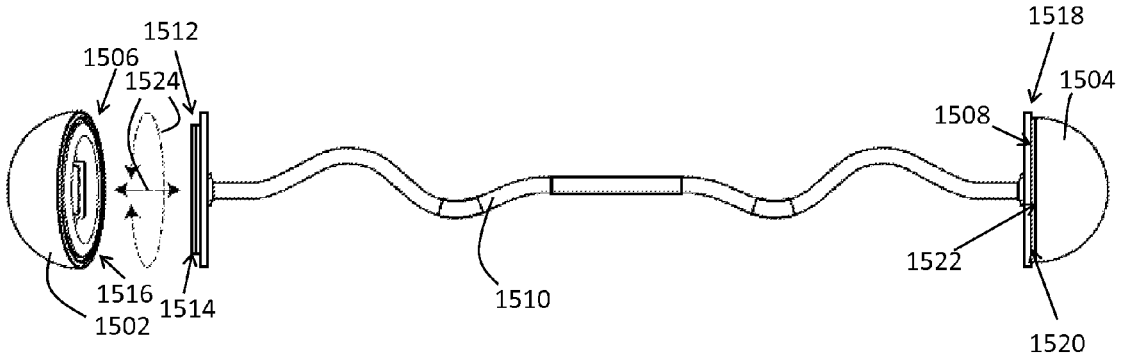
FIG. 15 is an elevational front view of a first and second push-up assembly disposed for attachment to a bar in accordance with one embodiment of the present invention.

With reference now to FIG. 15 another assembly 1500 configuration utilizing two push-up bodies 1502, 1504 is shown. More specifically, the configuration shown in FIG. 15 emulates a chest-press bar or curl bar. Advantageously, a user may utilize any embodiment of the above-described bodies and join the ends 1506, 1508 with a corresponding end, e.g., 1512, 1518, of a rigid bar 1510. Specifically, the bar 1510 may include a first end 1512 with a female engagement portion 1514 of a complementary size and shape to, and operable to fixedly couple with, the male engagement member 1516 coupled to an end 1506 of the first push-up body 1502. The bar 1510 also includes a second end 1518, opposite the first end 1512 of the rigid bar 1510, with a male engagement member 1520 operable to fixedly couple with the female engagement portion 1522 disposed on the end 1508 of the second push-up body 1504. As similarly discussed above, the female engagement portion 1522 would also be of a complementary size and shape to the male engagement member 1520 on the second end 1518 of the rigid bar 1510. The representative arrows, e.g., arrows 1524, depict the direction the push-up bodies 1502, 1504 are translated to couple to the ends 1506, 1508 of the bar 1510.

While FIG. 15 depicts the male/female connection mechanisms describe above in relation to FIG. 2, any other fastening mechanism may be utilized, e.g., electromagnets. Moreover, the bar 1510, which is preferably made of steel, wood, or another rigid material, is longer than it is wide is used to handle and support the bodies 1502, 1504 that are coupled thereto to effectively emulate other workout devices such as curl bar or straight bar. The bar 1510 may shaped and sized in various different forms based on its application(s). As weight may be added or removed to the bodies 1502, 1504, in a similar fashion described above, this configuration enables the user to advantageously stimulate various muscle groups in a progressive manner.

Figure 16:
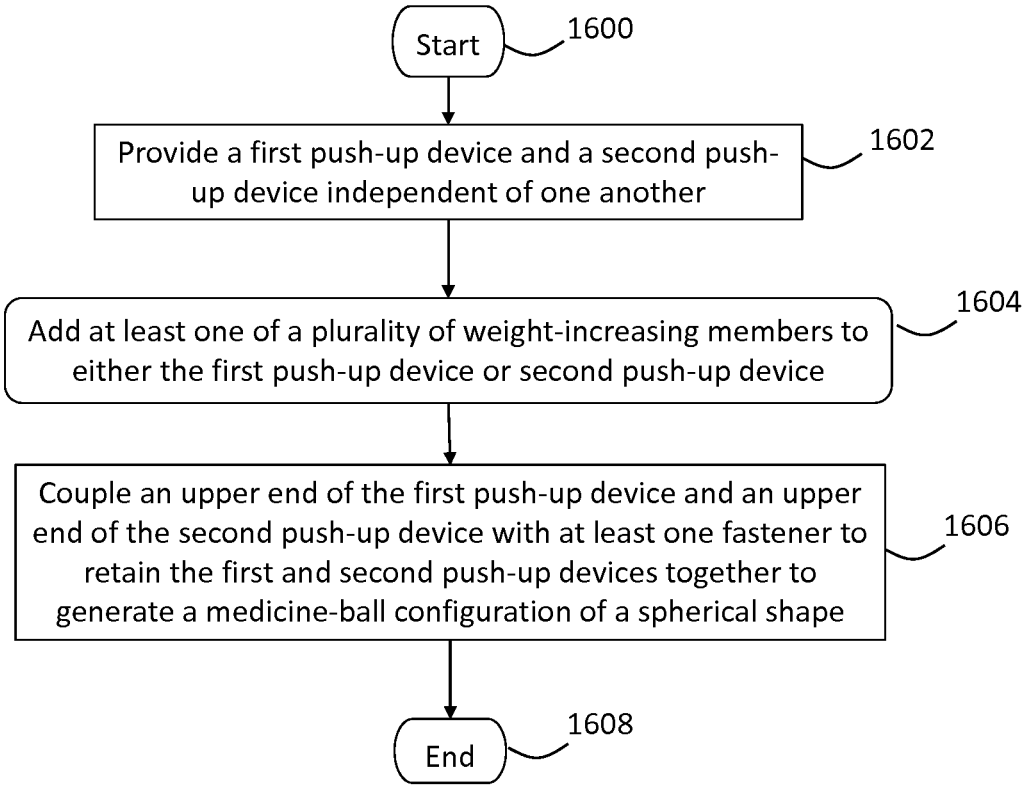
FIG. 16 is a process-flow diagram depicting a method of transforming a push-up device into another workout device in accordance with one embodiment of the present invention.

With reference now to FIG. 16, an exemplary process-flow diagram depicting a method of transforming a push-up device into another workout device is shown. In said process, the method begins as step 1600 and immediately proceeds to the step 1602 of providing a first push-up device and a second push-up device, independent of the first push-up device. The first and second push-up devices each have an upper end, a handle coupled to the upper end and disposed in a substantially upright orientation with respect to a plane defined by the upper end to which the handle is coupled. The first and second push-up devices also each have a lower end, and an outer hemispherical surface spanning from the lower end toward the upper end, as similarly described above.

As discussed above, before or after the first and second push-up devices are coupled together with a fastener, another step 1604 may include adding at least one of a plurality of weight-increasing members to either the first push-up device or the second push-up device. Again, the at least one of the plurality of weight-increasing members may be of a predetermined mass substantially equal to a positive integer value. Next, the process continues to the step 1606 of coupling the upper end of the first push-up device and the upper end of the second push-up device with at least one fastener to retain the first and second push-up devices together and generate a medicine-ball configuration forming a spherical shape. The process then terminates at step 1608.

A transformative push-up assembly has been disclosed that not only provides a safe and more effective push-up exercise than those known devices, but the assembly also is operable to emulate various other workout devices, such as a medicine ball or a curl bar. Furthermore, to progressively increase and stimulate various other muscle groups the assembly is also beneficially adapted to add weight thereto.

What is claimed is:

1. A transformable push-up assembly comprising:

a first push-up body having an upper end and a hemispherical outer surface extending from a ground contact surface substantially to an upper terminal periphery edge of the first push-up body;

a recess defined within a sidewall at the upper end of the first push-up body;

a handle coupled to the first push-up body, the handle recessed within the first push-up body and having a user-gripping portion surrounded by the upper terminal periphery edge; and a removable weight-increasing member stored within the recess and surrounding the user-gripping portion of the handle.

2. The transformable push-up assembly according to claim 1, wherein:

the handle is fully recessed within the first push-up body.

3. The transformable push-up assembly according to claim 2, wherein:

the hemispherical outer surface is formed of an elastically deformable material.

4. The transformable push-up assembly according to claim 3, further comprising:

a plurality of weights removably coupled to the first push-up body with a fastener, the plurality of weights being of a predetermined mass substantially equal to a positive integer value.

5. The transformable push-up assembly according to claim 1, wherein:

the removable weight-increasing member is circular.

6. The transformable push-up assembly according to claim 1, further comprising:

a male engagement member adapted to removably and fixedly couple with a complementary female engagement portion disposed on a second push-up body.

7. The transformable push-up assembly according to claim 1, further comprising:

a plate removably coupled to the first push-up body, the plate:

including the handle coupled thereto;

at least partially defining a first push-up internal cavity; and having a cantilever arm extending from a bottom surface of the plate into the first push-up internal cavity.

8. The transformable push-up assembly according to claim 7, further comprising:

a plurality of weights removably coupled to the cantilever arm with a fastener, the weights being of a predetermined mass substantially equal to a positive integer value.

9. The transformable push-up assembly according to claim 1, further comprising:

a second push-up body having a hemispherical outer surface extending from a ground contact surface substantially to an upper terminal periphery edge of the second push-up body; and a handle coupled to the second push-up body, the handle having a user-gripping portion surrounded by the upper terminal periphery edge and recessed within the second push-up body, wherein an upper surface of the second push-up body and an upper surface of the first push-up body are operably configured to fixedly couple with each other to form a spherical complete outer surface, the complete outer surface including the hemispherical outer surfaces of the first and second push-up bodies.

10. The transformable push-up assembly according to claim 9, further comprising:

a male engagement member coupled to the first push-up body; and a female engagement portion disposed on the second push-up body, the female engagement portion of a complementary size and shape to receive a portion of the male engagement member.

11. The transformable push-up assembly according to claim 10, further comprising:

a rigid bar having:

a first end with a female engagement portion of a complementary size and shape to, and operable to fixedly couple with, the male engagement member coupled to the first push-up body; and a second end, opposite the first end of the rigid bar, with a male engagement member operable to fixedly couple with the female engagement portion disposed on the second push-up body, the female engagement portion disposed on the second push-up body of a complementary size and shape to the male engagement member on the second end of the rigid bar.

12. A transformable push-up assembly comprising:

a first push-up body having an upper end, a lower end, and a curvilinear outer surface spanning from the lower end of the first push-up body toward the upper end of the first push-up body, the first push-up body including a handle coupled to the upper end of the first push-up body and at least partially recessed within the first push-up body;

a second push-up body having an upper end, a lower end, and a curvilinear outer surface spanning from the lower end of the second push-up body toward the upper end of the second push-up body, the second push-up body including a handle coupled to the upper end of the second push-up body and at least partially recessed within the second push-up body;

a removable weight-increasing member stored within a recess defined within a sidewall at the upper end of at least one of the first push-up body and the second push-up body;

a medicine-ball configuration with the first push-up body and the second push-up body removably coupled together with at least one fastener and with the upper end of the first push-up body and the upper end of the second push-up body in an overlapping adjacent relationship with each other; and a push-up configuration with the first push-up body and the second push-up body uncoupled from, and independent of, one another and the handles of the first push-up body and the second push-up body disposed in a substantially upright orientation with respect to a plane defined by the upper end of the respective first and second push-up body to which the handle is coupled, the handle having a portion extending downwardly away from the upper end of the respective first push-up body and the second-push up body.

13. The transformable push-up assembly according to claim 12, wherein the medicine-ball configuration further comprises:

the handle coupled to the first push-up body and the handle coupled to the second push-up body unexposed to an outside of the transformable push-up assembly.

14. The transformable push-up assembly according to claim 12, wherein:

a plane defined by the upper end of the first push-up body and a plane of the upper end of the second push-up body are substantially coplanar when in the medicine-ball configuration.

15. The transformable push-up assembly according to claim 12, wherein:

the medicine-ball configuration includes the first push-up body and the second push-up body together forming a spherical shape.

16. The transformable push-up assembly according to claim 12, wherein:

the curvilinear outer surface of the first push-up body and the curvilinear outer surface of the second push-up body are formed of an elastically deformable material.

17. The transformable push-up assembly according to claim 12, further comprising:

a male engagement member coupled to the first push-up body; and a female engagement portion disposed on the second push-up body, the female engagement portion of a complementary size and shape to receive a portion of the male engagement member, wherein the male and female engagement member retain the first push-up body and the second push-up body together in the medicine-ball configuration.

18. A method of transforming a push-up device into another workout device, the method comprising:

providing a first push-up device and a second push-up device, independent of the first push-up device, the first and second push-up devices each having an upper end, a handle coupled to the upper end and disposed in a substantially upright orientation with respect to a plane defined by the upper end to which the handle is coupled, a lower end, an outer hemispherical surface spanning from the lower end toward the upper end, a recess defined within a sidewall at the upper end of the first push-up body;

coupling the upper end of the first push-up device and the upper end of the second push-up device with at least one fastener to retain the first and second push-up devices together and generating a medicine-ball configuration forming a spherical shape; and storing a removable weight-increasing member within the recess, and surrounding the handle in at least one of the first-push up device and the second push-up device.

19. The method according to claim 18, wherein:

the handles of the first and second push-up devices are unexposed to a viewing public when in the medicine-ball configuration and the hemispherical outer surface of the first and second push-up devices are formed of an elastically deformable material.

20. The method according to claim 18, further comprising: adding an additional removable weight-increasing member to at least one of the first pushup device and second push-up device, the removable weight-increasing members being of a predetermined mass substantially equal to a positive integer value.

* * * * *